United States Patent [19]

Archambault

[11] Patent Number: 4,951,693

[45] Date of Patent: Aug. 28, 1990

[54] AUTOMATIC DOOR OPENING SYSTEM FOR DOMESTIC DISHWASHERS

[76] Inventor: Jean Archambault, 500 Francois Street - Apt 207, Ile des Soeurs, Province of Quebec, Canada, H3E 1G4

[21] Appl. No.: 369,242

[22] Filed: Jun. 21, 1989

[51] Int. Cl.[5] ..... B08B 3/02

[52] U.S. Cl. ..... 134/57 DL; 134/58 DL; 312/276; 292/DIG. 69

[58] Field of Search ..... 134/57 DL, 58 DL; 312/276; 292/DIG. 69; 68/12 R; 206/61.68

[56] References Cited

U.S. PATENT DOCUMENTS

| | | | |
|---|---|---|---|
| 2,217,705 | 10/1940 | Rataiczak et al. | 134/57 DL |
| 2,618,282 | 11/1952 | Stanitz et al. | 134/58 DL |
| 2,891,560 | 6/1959 | Ullman, Jr. et al. | 134/58 DL |
| 4,510,777 | 4/1985 | Ellingson et al. | 134/57 DL |

FOREIGN PATENT DOCUMENTS

| | | | |
|---|---|---|---|
| 2031053 | 4/1980 | United Kingdom | 134/57 DL |

*Primary Examiner*—Frankie L. Stinson

[57] ABSTRACT

In a conventional dishwashing machine having a front door biased to closed position by a pair of tension springs connected to rearwardly-extending arms of the door hinges, the addition of a pair of spring-loaded pushers acting on said arms through a restricted stroke and with a door-opening force overcoming the door-closing force of said tension springs. A solenoid-operated latch releasably locks the door in closed position. Said latch is operated by the timer controlled switching assembly of the machine, so as to release the door at the end of the rinsing cycle. Thus, the drying cycle is effected solely through free circulation of ambient air within the washing compartment through the partially-open door opening.

7 Claims, 3 Drawing Sheets

AUTOMATIC DOOR OPENING SYSTEM FOR DOMESTIC DISHWASHERS

FIELD OF THE INVENTION

This invention relates to dishwashing machines, and especially to a door opening mechanism therefor.

BACKGROUND OF THE INVENTION

In industrialized countries such as Canada, U.S.A., and the West European countries, the dishwashing machine is considered almost a "necessity", and a large majority of the families of these countries have one such machine. Such a machine automatically washes, rinses and dries dishes, knives and forks, glasses, and the like according to a timer-controlled washing/rinsing/drying cycle. The last cycle (the drying of the dishes that have been rinsed) is effected by heating the dishes with an electric heater while air is sucked in the dishwasher by a fan located close to the floor and then expelled from the dishwashing machine.

This conventional drying cycle has a few drawbacks, including:

(a) the air sucked into the machine moves close to the floor and will, in effect, render dirty again the cleaned dishes, by depositing thereon a fine layer of dust particles;

(b) the energy required to dry heat the rinsed dishes is not well spent money, since it does consume a lot of kWh;

(c) the heating element often causes cracking of plastic and porcelain dishes;

(d) the noise level of the machine is high during the washing and rinsing cycles, because insulation around the machine is incomplete, since there are an air inlet and an air outlet for the drying cycle.

OBJECTS OF THE INVENTION

The main object of the invention is to address the above-mentioned drawbacks.

A corollary object of the invention is to provide such a dishwashing machine, which will require few modifications of existing machines and which will be of low construction cost.

SUMMARY OF THE INVENTION

The invention is directed to a conventional dishwashing machine, which is electrically operated to sequentially effect a washing, a rinsing and a drying cycle under the control of a time-controlled switching means, the machine having a frame supporting a washing compartment with an access opening; a door hinged about said opening to pivot between open and closed positions; and first biasing means to bias the door to closed position.

In accordance with the invention, there are provided second biasing means to bias the door towards open position, exerting a door-opening force greater than the door-closing force of said first biasing means and effective when the door is within a range of positions intermediate and including said closed position and a predetermined partially-open position; means to cease action of said second biasing means when said door has attained said partially-open position; and an electrically-operated latch means to releasably latch the door in closed position and adapted to be operated by said switching means at the end of said rinsing cycle, so as to effect the drying cycle by free circulation of ambient air into said washing compartment through the partially-open door opening.

The invention is more particularly applicable to a domestic front-loading dishwashing machine with a vertical access opening at the front of the machine and with the door having a lower section provided with hinge members pivoted to the frame adjacent the bottom of the washing compartment. The hinge members each has an arm which extends rearwardly from the door in the closed position of the latter.

In this type of dishwashing machine, the first biasing means include tension springs attached to the free end portions of said arms and to said frame. In combination with said first biasing means, the second biasing means comprise for each hinge member an upright spring-loaded pusher including a plunger fixed to said frame below the free end of said arm and a cylinder surrounding a portion of said plunger and abutting the free end portion of said arm, the plunger having an enlarged head abutting against a step of said cylinder when the cylinder has reached the end of its upward stroke, the second biasing means further including a compression coil spring extending within said cylinder between the head of said plunger and the top of said cylinder. Preferably, a plug is screwed in the upper end portion of said cylinder. The upper end of said coil spring abuts against said plug, said plug being adjustable to adjust the length of the stroke of said plunger and, consequently, the predetermined partially-open position of said door.

The latch means preferably include a solenoid-operated plunger mounted within the top portion of the door, the solenoid being connected to the switching means to retract the plunger at the end of the rinsing cycle, so as to release a retainer member fixed to the frame of the machine and entering within the door. The solenoid-operated plunger is biased by a coil spring to an advanced position latching onto said retainer member.

BRIEF DESCRIPTION OF THE INVENTION

DETAILED DESCRIPTION OF THE INVENTION

Figure 1:
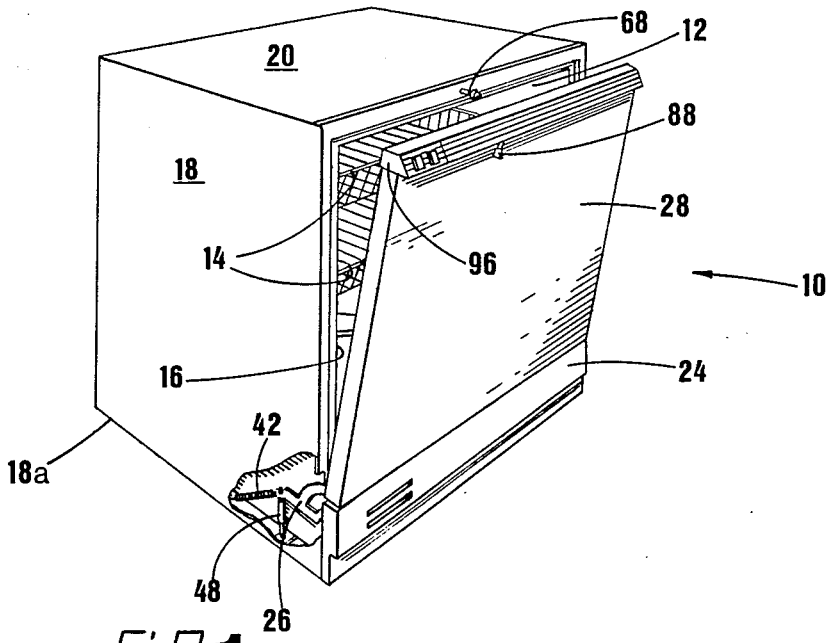
FIG. 1 is a perspective view of a dishwashing machine with the access door thereof being partly open and with a side wall thereof being partly broken to show the means to open and maintain the door in partially opened position.

The dishwasher 10 illustrated is of the domestic front-loading type. It includes a dish-receiving compartment 12 for washing, rinsing and drying dishes and the like disposed in trays 14. The compartment 12 has a front vertical access opening 16. The dishwasher has side walls 18 with a bottom edge 18*a*, a top wall 20. The washing compartment 12 is supported by a frame 22, with the bottom, not shown, of the washing compartment 12 spaced above a compartment 23 which houses the water pump, the electro valves and other parts of the mechanism of the dishwasher, said parts not shown, the lower compartment 23 being closed by a front panel 24 which is removable. A hinge member 26 is mounted inside the front portion of each side wall 18 for pivoting a large door 28 about a horizontal axis 29 between a vertical closed position closing the door opening 14, and a second horizontal position.

Hinge member 26 is of conventional construction and defines a central part 30 having one leg 32 extending forwardly and provided with an upturned ear 34 provided with a stud 29 pivotally engaging the frame 22 of the dishwasher. Each hinge member 26 has an upwardly-extending leg 36 extending within the door 28 and fixed thereto, and a rearwardly-extending arm 38 provided at its rear end with a hook 40 to which is attached one end of tension coil spring 42, the other end of which is attached at 44 to the bottom part of the frame 22. The two conventional springs 42 exert a closing force on the door 28 when partially opened and serve to dampen the opening movement of the door 28 when the latter reaches its fully-open horizontal position.

In accordance with the invention, each arm 38 is associated with a pusher member 48 adapted to exert, through a limited stroke, an opening force on the door 28 which is greater than the closing force exert on said door by the tension springs 42.

Each pusher 48 includes a plunger 50 having a lower threaded portion 52 adapted to be fixed upright to the bottom frame part 22 by nuts 54. The plunger 50 has an upper smooth end portion 56 which enters within and guides a cylinder 58. The top end of the plunger 50 is provided with an enlarged head 60 abutting against an inner step 62 of cylinder 58 when the latter reaches an uppermost position relative to plunger 50. The top end of cylinder 58 is inwardly threaded to receive a threaded plug 64. A compression coil spring 66 extends within the cylinder 58 and abuts against the plug 64 at the top end and against the head 60 of the plunger 50 at its lower end.

Figure 4:
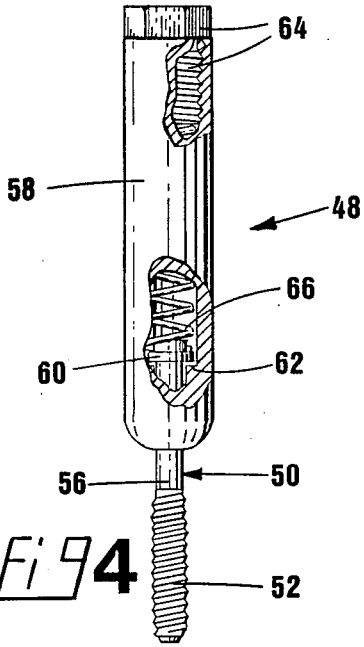
FIG. 4 is an enlarged partly-sectional elevational view of the pusher serving to bias the door to partially opened position.

FIG. 4 shows the pusher member 58 at practically its top limit position in which the head 60 abuts against step 62. When a downward force is exerted on plug 64, the coil spring 66 will be compressed and the cylinder 58 will move down along plunger portion 56. The pusher is located just underneath the hook 40 and plug 64, and cylinder 58 are pushed down against spring 66 when the door is fully closed, the hinge arm 38 being then substantially horizontal.

It will be understood that, if the door is unlatched, the pusher members 48 will open the door to a predetermined partially-open position against the action of the tension springs 42. The door will be kept in its predetermined open position when the head 60 of the plungers abuts against the step 62 which defines the effective stroke of the pusher members.

It is understood that adjustment of the axial position of the plug 64 relative to the cylinder 58 will enable one to adjust the predetermined open position of the door 28.

Figure 2:
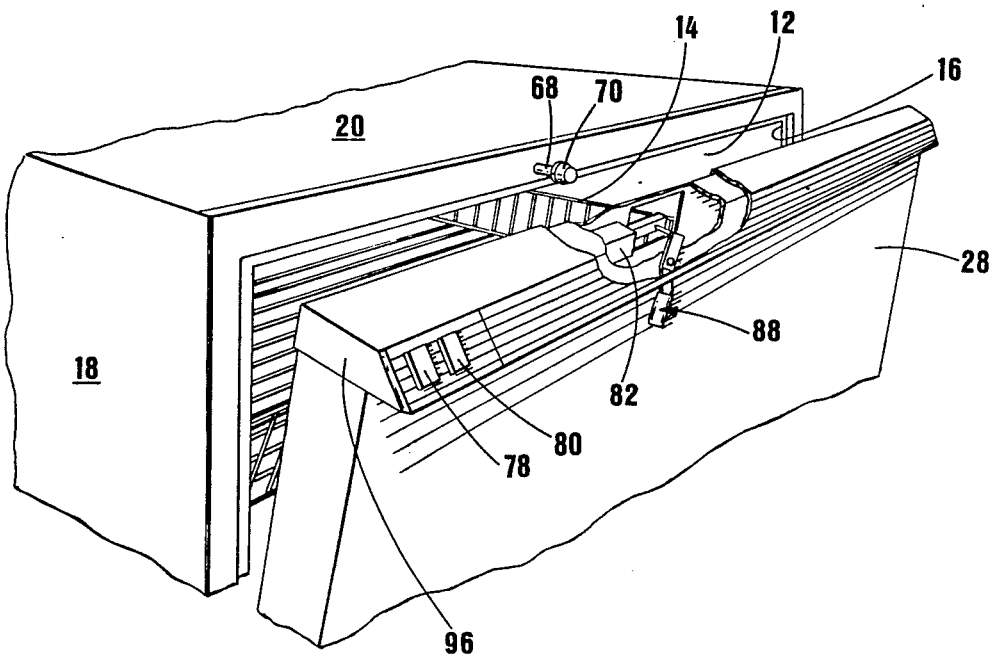
FIG. 2 is an enlarged broken view of the upper portion of FIG. 1, with the top edge section of the dishwasher door being partly broken to show the door latching system.
Figure 3:
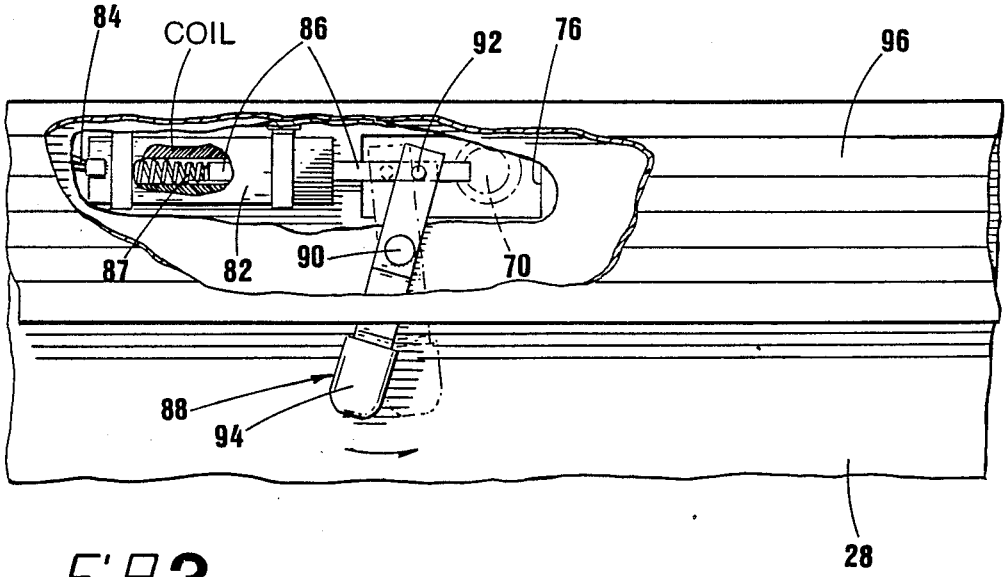
FIG. 3 is an enlarged front elevation of said door top edge section cut-away to show the door latching system.
Figure 5:
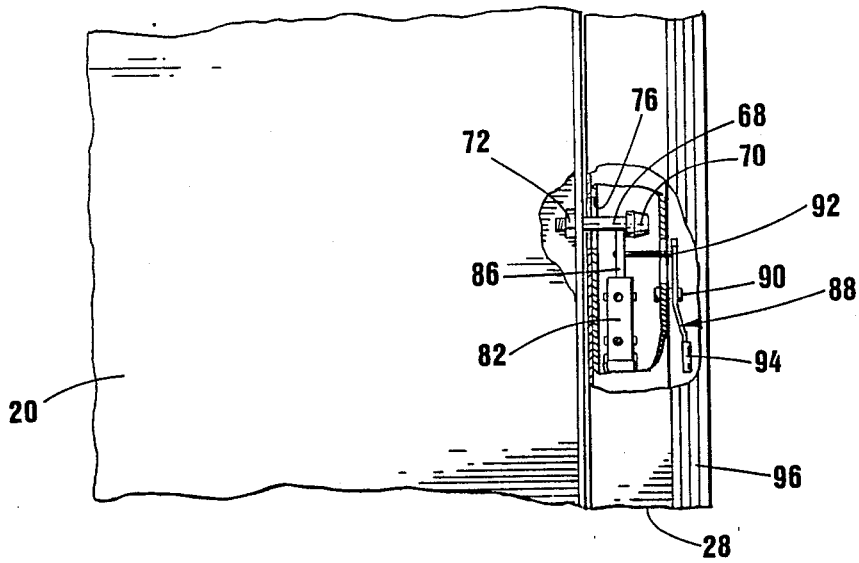
FIG. 5 is a broken top plan view of said dishwashing machine, showing the door latching system.
Figure 6:
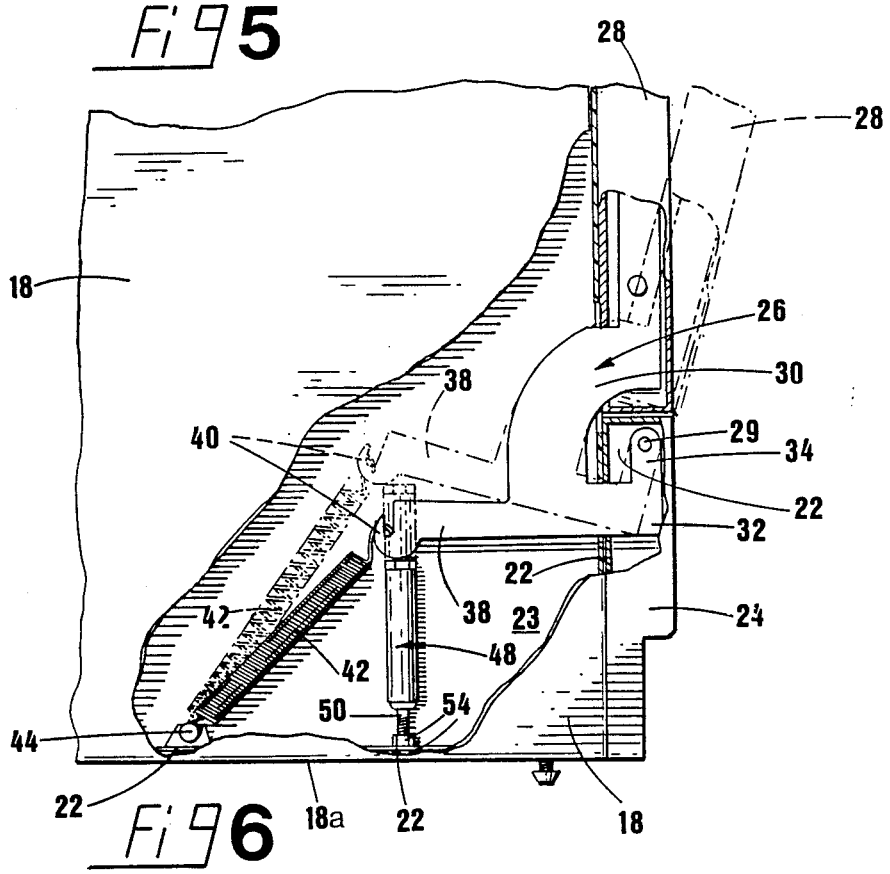
FIG. 6 is an enlarged elevational view of the bottom front portion of FIG. 1, showing the door opening means.

As shown in FIGS. 1, 2, and 5, the latching means in accordance with the invention includes a retainer member 68, in the form of a stem having an enlarged head 70. The retainer member is fixed by nuts 72 to the frame 22 of the dishwasher just above the washing compartment 12 and protrudes forwardly of the machine to enter within the top section of the door 28 when the door is in closed position (see FIG. 5). The head 72 enters through an opening 76 made in the top part of the door. The top section of the door conventionally carries a timer-controlled switching mechanism, not shown, which sequentially closes the different circuits to the water pump, the electro valves, the electric heating element and other parts for the washing, rinsing and drying cycles of the machine. This mechanism is started by, for instance, depressing a push-button 78 and can be stopped by depressing push-button 80. Any other type of actuating mechanism can be provided.

The latching means in accordance with the invention further include an electric solenoid 82 mounted within the top section of the door 28, the wires of which indicated at 84 are adapted to be connected to the above-noted switching means, so as to be energized at the end of the rinsing cycle just at the start of the drying cycle.

A plunger 86 is mounted within the solenoid 82 for reciprocative movement between a retracted position and an advanced position. A compression coil spring 87 is mounted within the solenoid and serves to push the plunger 84 to its advanced limit position. When the solenoid is electrically actuated, the plunger 86 retracts against the spring 87. When the door is manually pushed to closed position, the plunger will simply slide along the inclined head 70 and then engage behind the head to lock or latch the door in closed position, as shown in FIG. 5. Whenever the solenoid 82 is activated, the plunger 86 is retracted, thereby releasing the door which then automatically opens under the action of the pusher members 48.

With this arrangement, supposing the dishwashing machine is connected to a hot water supply and the last rinsing step is effected by hot water, it is no longer necessary to provide the dishwashing machine with an electric heating element, because when the door automatically opens, say about 4 inches, at the end of the rinsing cycle, the ambient air will freely circulate through the washing compartment and the already-hot dishes will quickly dry. Also, such dishwashing machine no longer needs to have an air-circulating fan with air inlet and air outlet.

The above-noted system will also ensure that the door will not open until the end of the rinsing cycle. This is a safety feature for small children. However, if it is desired to have the possibility to open the door at any time during the washing and rinsing cycles, a manually-operated lever 88 may be provided. This lever is pivoted intermediate its ends at 90 to the inside of the door; its inner end is pivoted at 92 to the plunger 86, while its outer end 94 is accessible below the conventional ledge 96 of the upper section of the door 28.

I claim:

1. In a dishwashing machine electrically operated to sequentially effect a washing, a rinsing and a drying cycle under the control of a timer-controlled switching means, said machine having a frame supporting a washing compartment with an access opening, a door hinged about said opening to pivot between open and closed positions and first biasing means to bias said door to closed position, the improvement including second biasing means to bias said door towards open position, exerting a door opening force greater than the door-closing force of said first biasing means and effective when the door is within a range of positions intermediate and including said closed position and a predetermined partially-open position; means to cease action of said second biasing means when said door has attained said partially-open position, and an electrically-operated latch means to releasably latch said door in closed position and adapted to be operated by said switching means at the end of said rinsing cycle, so as to effect said drying cycle by free circulation of ambient air into said washing compartment through the partially-open door opening.

2. In a dishwashing machine as defined in claim 1, wherein said machine is of the front-loading type, with said access opening substantially vertical at the front of said machine and with said door having a lower section provided with hinge members pivoted to said frame adjacent the bottom of said washing compartment, said hinge members each having an arm which extends rearwardly from said door in the closed position of the latter, said first biasing means including tension springs attached to the free end portion of said arms and to said frame, said second biasing means comprising for each hinge member an upright spring-loaded pusher including a plunger fixed to said frame below the free end portion of said arm and a cylinder surrounding a portion of said plunger and abutting said free end portion, said plunger having an enlarged head disposed within said cylinder and abutting against a step of said cylinder, and a compression coil spring within said cylinder between the upper end thereof and said enlarged head, said head and step constituting said means to cease action of said second biasing means when the door has attained a partially-open position.

3. In a dishwashing machine as defined in claim 2, wherein said latch means include an electrical solenoid, a plunger mounted within said solenoid and retractable therein when said solenoid is energized; a second spring urging said plunger to an advanced position, said plunger, when in advanced position, effective to lock said door in closed position, and when retracted, releasing said door.

4. In a dishwashing machine as defined in claim 3, wherein said latch means is mounted within the top portion of said door and further including a retainer member fixed to said frame and entering said door when the latter is in closed position, said plunger latching onto said retainer member under the action of said second spring and releasing said retainer when retracted by said solenoid.

5. In a dishwashing machine as defined in claim 2, wherein said cylinder has a top inwardly threaded portion and further including a plug adjustably screwed in said portion.

6. In a dishwashing machine as defined in claim 1, wherein said latch means include an electrical solenoid, a plunger mounted within said solenoid and retractable therein when said solenoid is energized; a second spring urging said plunger to an advanced position, said plunger, when in advanced position, effective to lock said door in closed position, and when retracted, releasing said door.

7. In a dishwashing machine as defined in claim 6, wherein said latch means is mounted within the top portion of said door and further including a retainer member fixed to said frame and entering said door when the latter is in closed position, said plunger latching onto said retainer member under the action of said second spring and releasing said retainer when retracted by said solenoid.

* * * * *